United States Patent [19]

Holzbaur et al.

[11] 4,348,999

[45] Sep. 14, 1982

[54] APPARATUS FOR MIXTURE FORMATION FOR INTERNAL COMBUSTION ENGINES, IN PARTICULAR MIXTURE-COMPRESSING ENGINES HAVING EXTERNALLY SUPPLIED IGNITION

[75] Inventors: Siegfried Holzbaur, Stuttgart; Horst Barth, Asperg; Josef Osmera, Schwieberdingen, all of Fed. Rep. of Germany

[73] Assignee: Robert Bosch GmbH, Stuttgart, Fed. Rep. of Germany

[21] Appl. No.: 177,339

[22] Filed: Aug. 12, 1980

[30] Foreign Application Priority Data

Aug. 24, 1979 [DE] Fed. Rep. of Germany ..... 2934216

[51] Int. Cl.[3] ..... F02M 39/00

[52] U.S. Cl. ..... 123/452; 261/50 A

[58] Field of Search ..... 123/452–455; 261/44 A, 50 A

[56] References Cited

U.S. PATENT DOCUMENTS

| | | | |
|---|---|---|---|
| 4,143,102 | 3/1979 | Muller et al. | 123/452 |
| 4,154,203 | 5/1979 | Peters et al. | 123/452 |
| 4,175,102 | 11/1979 | Greiner et al. | 123/452 |
| 4,184,466 | 1/1980 | Nagele | 123/455 |
| 4,227,500 | 10/1980 | Wessel et al. | 123/455 |

*Primary Examiner*—Ira S. Lazarus
*Assistant Examiner*—Magdalen Moy
*Attorney, Agent, or Firm*—Edwin E. Greigg

[57] ABSTRACT

An apparatus is proposed which serves the purpose of mixture formation for internal combustion engines, in particular mixture-compressing engines with externally supplied ignition. The apparatus includes an air flow rate meter, which has at least one control body opening the intake tube cross section to a greater or lesser extent in accordance with the air flow to the cylinders, the deflection of which control body directly controls a fuel metering valve. The fuel metering valve is disposed on the end of the control body and extends in a direction pointing in opposition to that of the air flow and is embodied as a needle valve having a metering needle and a metering opening. The metered fuel can be ejected directly downstream of the fuel metering valve via one or more nozzle openings. As a result of the compact, small structure, one apparatus can be associated with each cylinder of the engine directly upstream of the inlet valve and a throttle valve, the various individual throttle valves and the individual control bodies being interconnected and adjustable in common. As a result unequal distribution of the metered fuel-air mixture to the various individual cylinders of the engine is prevented.

19 Claims, 9 Drawing Figures

FIG.4
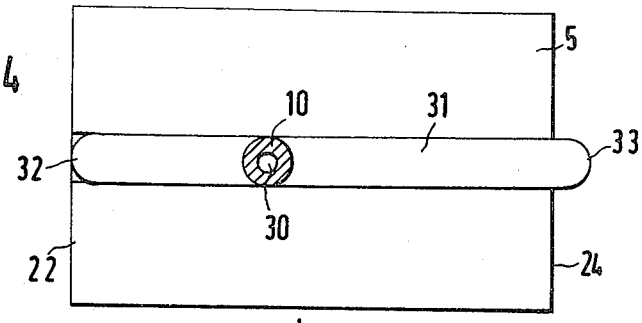
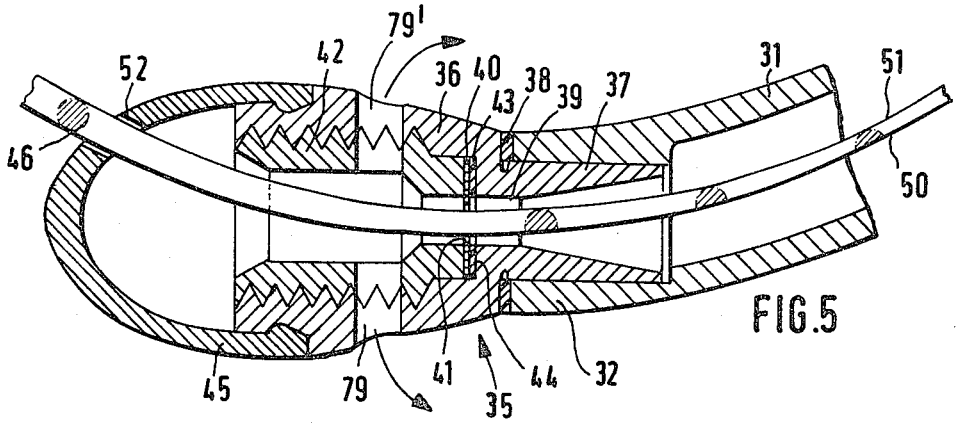
FIG.5
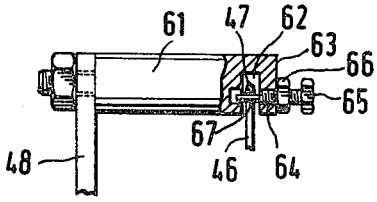
FIG.6
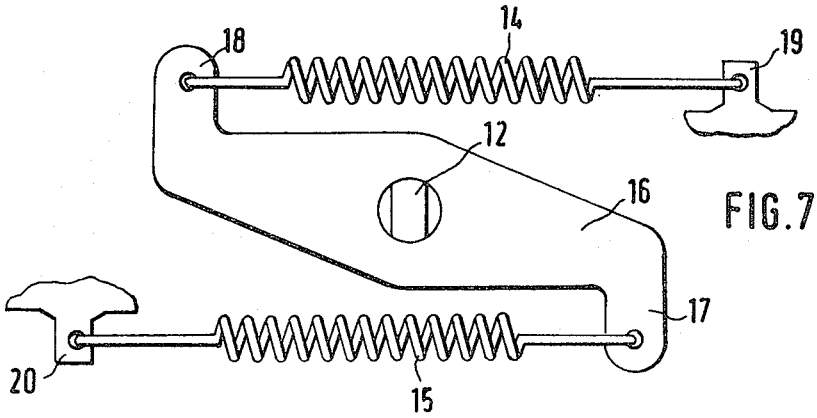
FIG.7

APPARATUS FOR MIXTURE FORMATION FOR INTERNAL COMBUSTION ENGINES, IN PARTICULAR MIXTURE-COMPRESSING ENGINES HAVING EXTERNALLY SUPPLIED IGNITION

BACKGROUND OF THE INVENTION

The invention generally relates to an apparatus for mixture formation for internal combustion engines, and, more particularly, to an apparatus for mixture formation in which an intake air flow rate meter directly controls a fuel metering valve for supplying fuel to at least one fuel injection nozzle. In a known apparatus for mixture formation, described in U.S. Pat. No. 4,184,466, issued Jan. 22, 1980 to Nagele, a fuel metering valve is disposed in the axis of an air flow rate meter and the metered fuel is then delivered via a channel to an injection nozzle disposed on the rim of a baffle valve, which opens an intake tube cross section to a greater or lesser extent in accordance with the air flow. In such an apparatus, however, there is the disadvantage that there is a relatively great distance between the fuel metering valve and the injection nozzle, so that if there is a change in the quantity of fuel metered at the fuel metering valve, the fuel quantity ejected at the injection nozzle does not immediately adapt itself to the new value but instead does so only in a delayed fashion. Not only can the engine exhaust gases be unfavorably affected thereby, but there can also be undesirable effects on engine running behavior.

OBJECT AND SUMMARY OF THE INVENTION

The apparatus for mixture formation according to the invention, includes an air flow rate meter having a control body disposed within an air intake tube of the engine. The control body is deflectable counter to a restoring force, in accordance with the air flow to the engine. A fuel metering valve, preferably a needle valve, is directly controlled by the deflection of the control body. The fuel metering valve is disposed within the air intake tube on the control body, preferably on a leading end of the control body. The metered fuel is ejected into the air intake tube directly downstream of the fuel metering valve via at least one injection nozzle which is disposed on the control body adjacent to the fuel metering valve.

The apparatus, according to the invention has the advantage over the prior known apparatus in that the metered fuel is ejectable directly downstream of the fuel metering valve on the control body, so that at the moment there is a change in the metered fuel quantity, the injected fuel quantity also changes simultaneously and in the identical manner. As a result, not only can the production of toxic components in the exhaust gas be kept as low as possible, but engine running can also be favorably affected; for instance, during acceleration, a sufficiently rich fuel-air mixture can be made available immediately for accelerating the engine.

As a result of the characteristics disclosed in the dependent claims, advantageous modifications of and improvements to the apparatus disclosed in the main claim are possible.

It is particularly advantageous to embody the fuel metering valve as a needle valve, whose metering needle is attached to the housing and is curved in circular fashion so that upon a pivoting movement by the control body, the metering needle opens to a greater or lesser extent, which is provided in a disc-like shield body disposed on the control body. The metering needle is manufactured from a material having a circular cross section and has a metering region which has a greater or lesser amount of material removed from it only on the circumferential side of the metering needle forming the larger circular curve. A fuel metering needle of this kind not only can be inexpensively manufactured and easily mounted, but also permits extremely precise fuel metering, while adaptation of the metered fuel quantity to the operational states of the engine is simply effected.

It is also advantageous to dispose a throttle valve in each individual intake tube directly upstream of the inlet valve of each cylinder of the engine and to dispose a control body upstream of each throttle valve, and to connect the various throttle valves and control bodies with one another and to adjust them in common. As a result, the delivery of different fuel-air mixtures to the individual cylinders of the engine caused by unfavorable flow conditions in the air intake tube, which leads to the production of toxic exhaust components, is avoided. It is possible to affect the fuel-air mizture formed at the individual apparatuses in each individual intake tube as follows: the individual metering needles are supported on a bearing lever, for instance, and the individual bearing levers are connected with one another by a connecting member, with the interposition of compensation members, and the connecting member can be engaged arbitrarily or in accordance with operating characteristics of the engine in order to bring about the adjustment movement.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 4 is a plan view on a control body, in a section taken along the line IV—IV of FIG. 2;

FIG. 5 is a section through a fuel metering valve on an enlarged scale, taken along the line V—V of FIG. 1;

FIG. 6 shows in detail the support of a metering needle;

FIG. 7 is a section taken along the line VII—VII of FIG. 8;

DESCRIPTION OF THE PREFERRED EMBODIMENT

Figure 1:
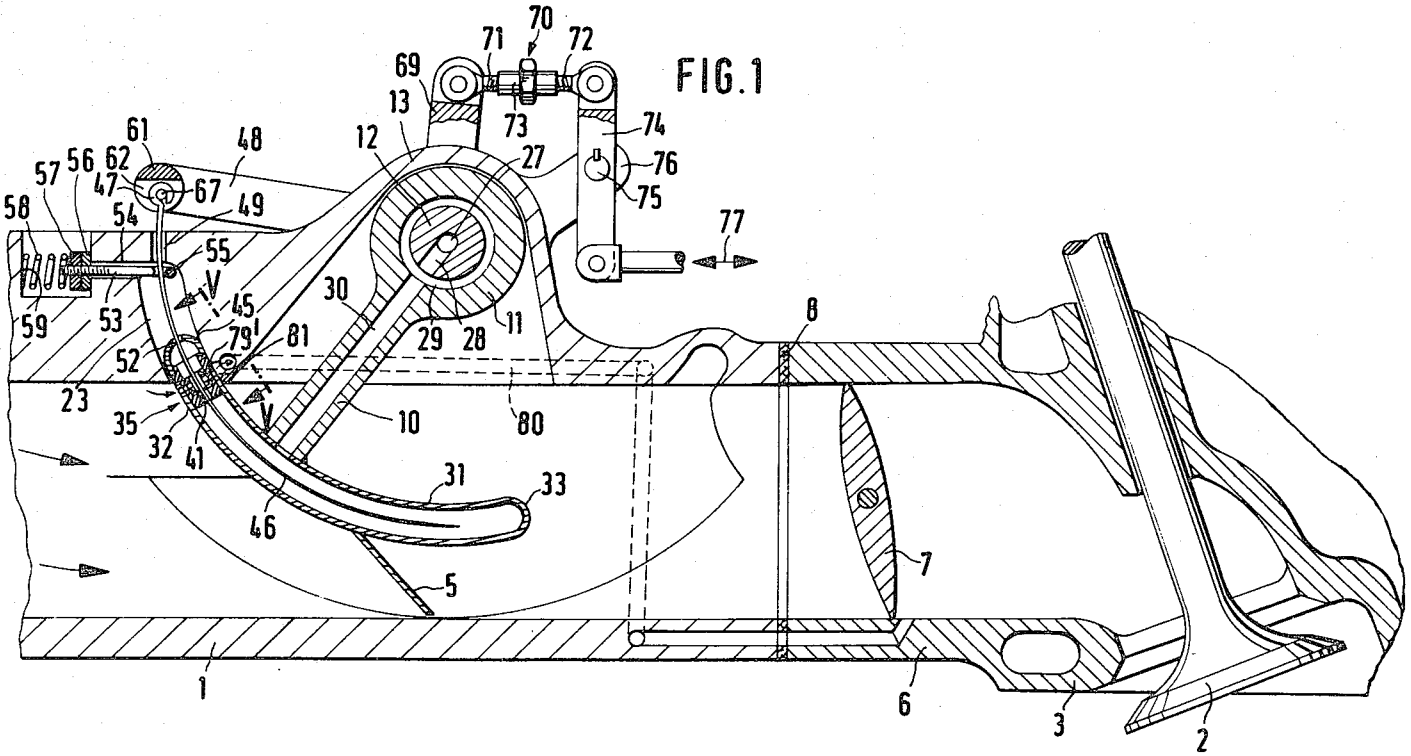
FIG. 1 shows generally in cross-section an apparatus for mixture formation in the idling position, in a section taken along the line I—I of FIG. 9.

In the apparatus shown in FIG. 1 for producing an operational mixture, the air required for combustion flows in the direction of the arrow into an air intake section 1, in particular of an individual intake tube directly upstream of an inlet valve 2, that is, downstream of an air intake manifold, not shown, of an internal combustion engine having one or more cylinders 3, in particular a mixture-compressing engine with externally-supplied ignition. Disposed in the intake tube section 1 is an air flow rate metering device embodied by an air flow rate meter 5 and which, in its outset position, as shown, blocks the air intake section 1. A throttle valve 7, which is embodied in as streamlined a fashion as possible, is disposed downstream of the air flow rate meter 5 in an air intake section 6 in communication with the cylinder 3. An oscillation damping member 8 is provided between the air intake sections 1 and 6. The air flow rate meter 5, which is embodied with walls as thin as possible, is embodied as rectangular, as shown in FIG. 4, and is secured to a connecting bar 10, which has a hub 11 on the other side by way of which it is connected to a pivoting shaft 12. The pivoting shaft 12 is supported rotatably in a housing portion 13 and extends transversely to the air flow direction. The air flow rate meter 5 represents a control body which opens the intake tube cross section to a greater or lesser extent depending on the air flow to the cylinders 3 of the engine and which essentially represents a plane lying outside the pivoting shaft 12. The pivotal movement of the air flow rate meter 5 about the pivoting shaft 12 occurs counter to a restoring force, which is shown by way of example in FIGS. 7 and 8 and provided by means of two restoring springs 14 and 15 disposed parallel to one another. To this end, a double lever 16 is connected in a twist-free manner with the pivoting shaft 12, and its ends 17 and 18 are bent in opposite directions. The restoring spring 14 on one end engages the end 18 of the double lever 16 and on the other end engages a support tang 19 attached to the housing; the restoring spring 15, meanwhile, on one end engages the end 17 of the double lever 16 and on the other end engages a support tang 20 attached to the housing. The parallel disposition of the restoring spring 14 and 15 serves to prevent tilting of the pivoting shaft 12. By the selection of the position of the support tangs 19, 20, the size of the particular restoring force for various rotational positions of the pivoting shaft, and accordingly the characteristic curve of the air flow rate meter, can be influenced.

Figure 3:
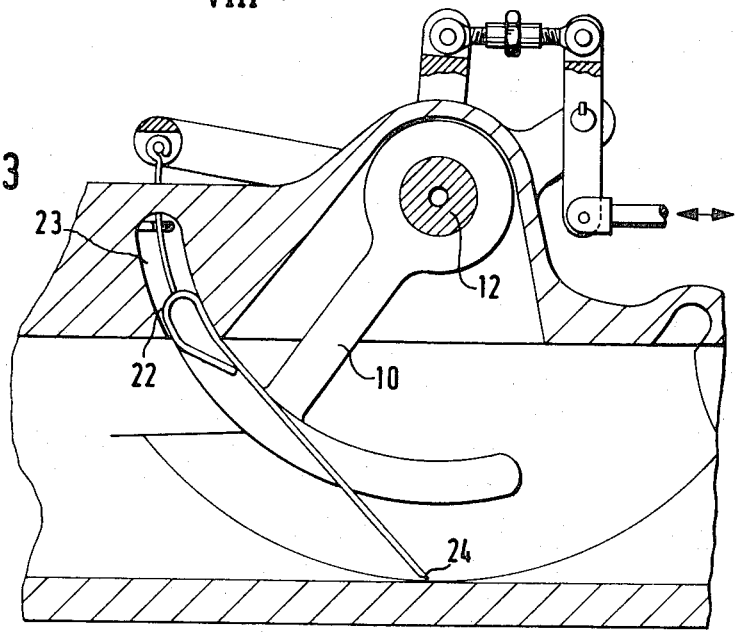
FIG. 3 shows an apparatus for mixture formation in the idling position, in a section taken along the line III—III of FIG. 9.

As shown in FIG. 3 as well, a leading or front end 22 of the air flow rate meter 5, which is loop-like for the purpose of improved air guidance, protrudes into an indentation 23 of the intake tube wall 1 in the outset position of the air flow rate meter 5 and thus blocks the intake tube cross section at this end, while a rear end 24 of the air flow rate meter 5 rests on the opposite intake tube wall. When the quantity of flowing air is small, during idling operation of the engine, the air flow rate meter 5 pivots about the pivoting shaft 12 into a position in which the front end 22 pointing in the direction opposite to that of the air flow continues to remain in the indentation 23, so that no air can pass by this front end 22, while at the rear end 24 of the air flow rate meter 5, a flow cross section is opened. The air flow rate meter functions in this range according to the principle of baffle-type resistance to air flow. With an increasing air quantity, the air flow rate meter 5 pivots with its front end 22 out of the indentation 23, so that a further flow-through cross section is opened at the end 22, and the air flow rate meter has air flowing past it at both ends. Now the air flow rate meter functions according to the air foil principle, and larger adjustment forces are available, especially in the vicinity of the full-load range, for displacing the air flow rate meter 5.

Figure 9:
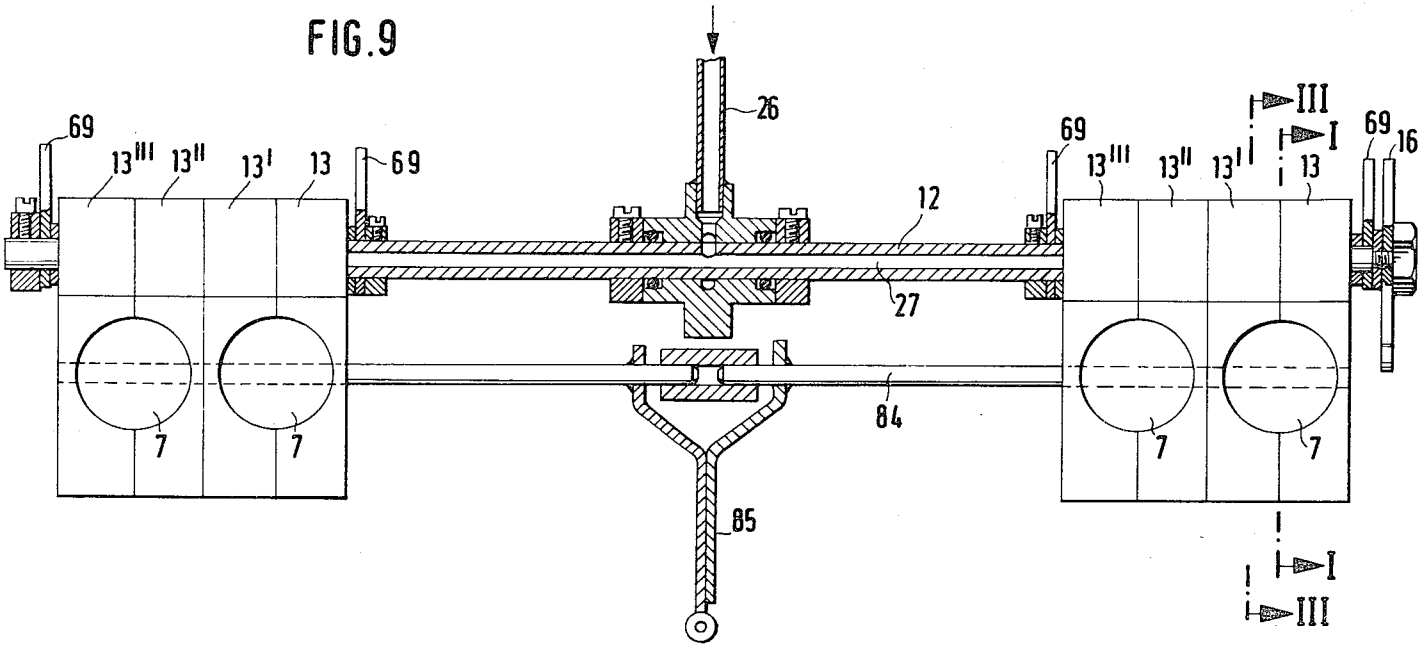
FIG. 9 is an illustration showing a plurality of apparatuses for mixture formation.

The supply of fuel in this apparatus is effected via a fuel supply line 26, as shown in FIG. 9, which communicates in a manner which is not shown with the compression side of a fuel supply pump, also not shown. The fuel supply line 26 discharges into a fuel channel 27 extending axially in the pivoting shaft 12. The fuel channel 27 communicates via a tap line 28 with an annular groove 29 in the hub 11 of the connecting bar 10. A fuel channel 30 is likewise provided in the connecting bar 10 and leads from the annular groove 29 to a circularly curved sheath 31, which is preferably disposed in the middle area of the air flow rate meter 5 and communicates with the air flow rate meter 5 and the connecting bar 10 in such a manner that its end 32 which extends in the direction opposite to that of the flow coincides in the spatial disposition with the end 22 of the air flow rate meter 5, so that this end 32 of the sheath 31 protrudes into the indentation 23 in the outset position of the air flow rate meter 5 and the idling position, while in the full-load position of the air flow rate meter 5 it is located approximately in the middle of the flow cross section. The end 33 of the sheath 31 which extends in the flow direction is closed.

A fuel metering valve 35 is disposed on the end 32 of the sheath 31 and thus on the end 22 of the air flow rate valve 5 pointing opposite to the flow direction, and this valve 35 is shown on an enlarged scale in FIG. 5. A reception body 36 having an extension 37 is inserted into the end 32 of the sheath 31 and secured. A sealing element 38 on the end face of the sheath end 32 prevents the escape of fuel via the extension 37 out of the interior of the sheath 31. The reception body 36 is provided with an axial passageway or bore 39, the cross section of which at its narrowest point is defined by a metering opening 41 provided in a disc-like body 40. The shield body 40, in disc-like form, is manufactured from material which is as thin as possible and is pressed by a securing element 42, such as a headless screw, with an interposed sealing element 43, against a stop 44 of the bore 39. A cap 45 of tear drop from having the most favorable possible effect on the air flow is disposed on the end of the reception body 36 remote from the sheath 31.

The fuel metering valve 35 is embodied as a needle valve having a metering needle 46 cooperating with the metering opening 41. The metering needle 46 is embodied in the form of a loop at its one end 47 and is secured, attached to the housing, on a bearing lever 48, which is located outside the housing 13 and suported on its other end, for example, on the pivoting shaft 12 but is rotatable relative thereto (see FIG. 8, for example). The air flow rate meter 5 is guided by the connecting bar 10 in such a manner that the plane which it determines extends substantially outside the pivoting shaft 12. The metering needle 46 protrudes through an opening 49 in the housing wall 13 into the indentation 23 and is circularly curved in such a manner that upon a pivoting movement on the part of the air flow rate meter 5, and engaging an opening 52 in the cap 45, it opens the metering opening 41, through which the metering needle 46 protrudes to a greater or lesser extent. The metering needle 46 is manufactured of material having a circular cross section and has a metering area, in which more or less material is removed only on the circumferential side 50 of the metering needle 46 representing the larger circular arc—that is, the side 50 remote from the connecting bar 10, as is shown in the cross-sectional views of the metering needle 46 according to FIG. 5. In order to prevent a displacement in position of the metering needle 46 relative to the metering opening 41 from causing different metering quantities, the metering needle 46 should be guided in such a manner that on its circumferential side 51 representing the smaller circular arc and oriented toward the connecting bar 10 it rests against the metering opening 41. The position of the metering needle 46 relative to the metering opening 41 can be influenced first by means of an actuation member 53, which is disposed in a housing bore 54 and grippingly surrounds the metering needle 46 with a hook-like end 55. The actuation member 53 is displaceable within the housing bore 54 and has a thread on its end remote from the hook-like end 55 onto which an adjusting nut 56 and a lock nut 57 are threaded. A compression spring 58 is supported on the lock nut 57 and is supported on the other end, attached to the housing, on a stop 59 of the housing 13. The metering needle 46 can thus be deflected in the axial direction counter to the force of the compression spring 58. FIG. 6 shows as a detail the suspension of the metering needle 46 via its loop 47 on the bearing lever 48, in a side view. A shaft 61 is connected with the bearing lever 48 and has a recess 62 transverse to the longitudinal axis thereof. Parallel to the longitudinal axis of the shaft, a threaded bore 64 is provided, extending from the side face 63 of the bolt 61 toward the recess 62, into which a screw 65 with a lock nut 66 is threaded. On the end of the screw 65 oriented toward the recess 62, a suspension pin 67 extending eccentrically with respect to the screw axis is connected with the screw body; the suspension pin 67 extends transversely to the recess 62 and the loop-like end 47 of the metering needle 46 is suspended on this suspension pin 67. Rotation of the screw 65 thus enables a vertical displacement of the metering needle 46 relative to the metering opening 41.

The bearing lever 48 can be connected with an actuation lever 69, on which a so-called tension lock or turnbuckle 70 is pivotally supported, embodied by two threaded pins 71, 72 having threads running in opposite directions and a threaded sheath 73 connecting the two threaded pins 71,72. On the other end the tension lock 70 engages a pivot lever 74, which is connected in a twist-free manner with a rotary shaft 75 supported on support points 76 attached to the housing. By twisting the threaded sheath 73 of the tension lock 70, the position of the metering needle 46 relative to the metering opening 41 can be varied in a precise manner. An intervention can be made at the pivot lever 74, either arbitrarily or in accordance with operational variables of the engine such as temperature, pressure, or exhaust gas composition, in the direction of the arrow 77 in order to vary the fuel-air mixture.

Directly downstream of the metering opening 41, at least one radial nozzle opening 79, 79' is provided, which beginning at the passageway bore 39 passes through the securing element 42 and the reception body 36 and by way of which the metered fuel can be injected. The fuel exiting at the nozzle openings 79, 79' can be carried away immediately in the direction of the arrow by the air flowing at a high flow velocity and thus finely distributed. In FIG. 1, the air flow rate meter 5 is shown in its idling position in which at least one of the nozzle openings 79' is covered by the indentation 23, while the other nozzle opening or openings 79 is or are exposed to the air flow.

It has proved to be efficient for the idling mixture quantity to be injected via a separate idling mixture channel 80, which is provided in the housing 13 and the intake tube walls 1, 6 and which discharges back into the intake tube section 6 downstream from the throttle valve 7. To this end, a funnel-like collector channel 81 is provided in the region of the indentation 23, in which the one nozzle opening 79' is located in the idling position of the air flow rate meter 5. On the other end, the collector channel 81 discharges into the idling channel 80. The air flowing into the intake tube section 1 in the direction of the arrow likewise flows, as indicated by the arrow, via at least one nozzle opening 79 which is opened toward the intake tube in the idling position of the air flow rate meter 5 and so carries the idling fuel, metered at the fuel metering valve 35, along with it via the nozzle opening 79' into the collector channel 81 and from thence, in turn, on into the idling channel 80.

Figure 2:
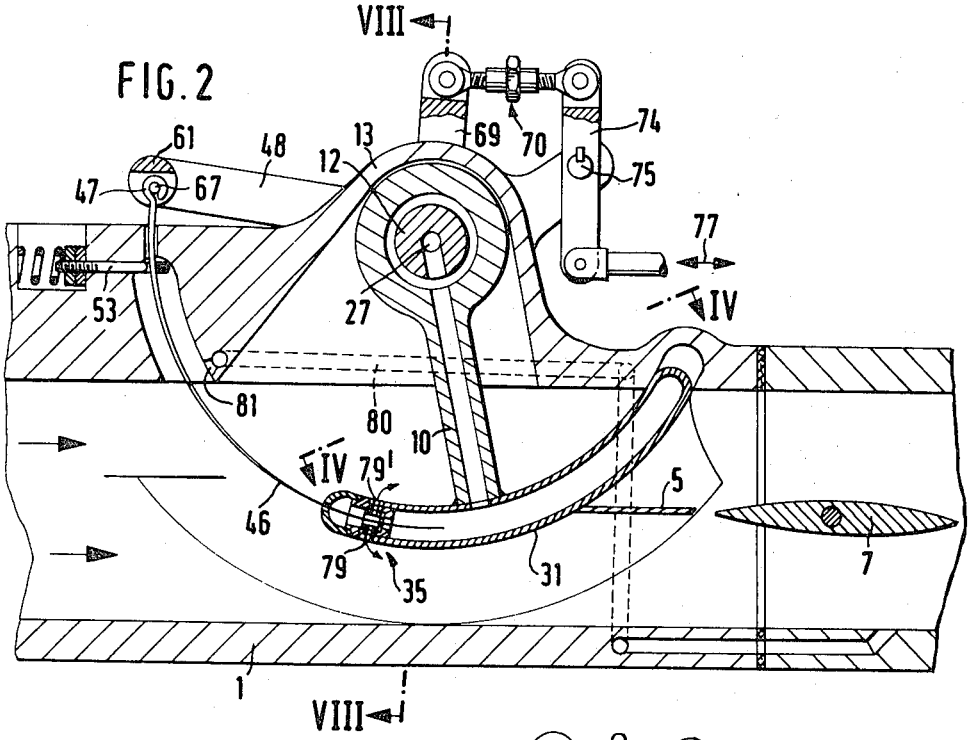
FIG. 2 shows an apparatus for mixture formation in the full-load position.

In FIG. 2, the air flow rate meter 5 is shown in its full-load position in which the fuel metering valve 35 and thus the nozzle openings 79 and 79' are located approximately in the middle of the intake tube, that is, in a region of maximum air velocity and maximum distance away from the walls of the intake tube. As a result, fuel deposit onto the walls of the intake tube is to the greatest possible extent avoided. The very large adjustment path of the fuel metering valve 35 between the idling position and the full-load position produces very good dissolution capacity on the part of the fuel metering valve 35 and results in very good adaptability to the various operational ranges of the engine.

Figure 8:
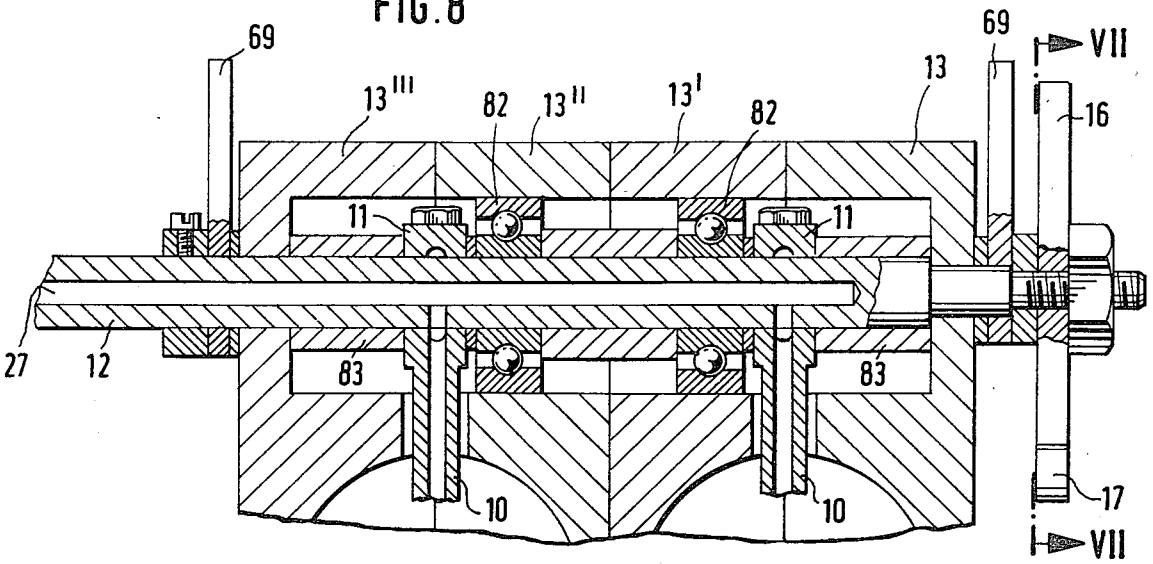
FIG. 8 is a section taken along the line VIII—VIII of FIG. 2.

As shown in FIGS. 8 and 9, an apparatus for producing an operational mixture is provided in each individual intake tube 1, 6 directly upstream of the inlet valve 2 of each cylinder 3 of the engine, upstream of each throttle valve 7, each apparatus having one air flow rate meter 5 and an associated fuel metering valve 35. Thus it may be particularly advantageous for a plurality of apparatuses for mixture formation—in the illustrated example, two such apparatuses—to be combined into a compact assembly unit, which is embodied by housing portions 13, 13', 13'', 13''', in which the pivoting shaft 12 is supported, by ball bearings 82, for instance, in a manner which is as free of friction as possible. The individual hubs 11 of the connecting bars 10 are connected in a twist-free manner with the pivoting shaft and are fixed in their position relative to the housing by spacer sheaths 83. By means of the fixed coupling of each air flow rate meter 5 with the pivoting shaft 12, all the various air flow rate meters 5 are in the same position. Thus, the total air quantity flowing to the cylinders of the engine is always measured. The throttle valves 7 disposed directly upstream of each inlet valve 2 are likewise disposed on a common throttle valve shaft 84 and are adjustable in common via a lever 85 by means of the gas pedal, not shown, for instance of a motor vehicle.

In the same manner, the pivot levers 74 (see FIGS. 1 and 2) of the individual apparatuses are supported in a twist-free manner on the rotary shaft 75, so that a twisting of the rotary shaft 75 simultaneously causes a pivoting of all the metering needles 46 in order to influence the fuel-air mixture.

The described apparatus for mixture formation has the advantages of a compact and very small structure, inexpensive and very simple manufacture and assembly, and fuel metering which is very precise and associated with each cylinder of the engine, while the fuel-air mixture is very well prepared.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In an apparatus for mixture formation for internal combustion engines, including at least one air intake tube, a fuel metering valve and an air flow rate meter having at least one control body which includes front and rear end portions and which is arranged to block an intake tube cross section in its outset position and to deflect counter to a restoring force in accordance with the air flow to the cylinders of the engine, thereby opening said intake tube cross section to a greater or lesser extent, said control body deflection arranged to directly control said fuel metering valve, the improvement wherein:

said fuel metering valve is disposed on said front end portion of said control body whereby the position of said fuel metering valve in the intake tube cross section varies in accordance with the position of said control body; and said apparatus further comprises fuel ejection means, which is disposed on the control body adjacent to, and directly downstream of said fuel metering valve for ejecting fuel metered by said fuel metering valve.

2. An apparatus as defined by claim 1, characterized in that said fuel metering valve further includes a needle valve arranged to cooperate with means defining a metering opening.

3. An apparatus as defined by claim 2, characterized in that said fuel metering valve further includes a shield means, said shield means encircling said needle valve and defining said metering opening.

4. An apparatus as defined by claim 2, characterized in that said control body is pivotably supported on an axis extending transversely to the air flow, said control body further having a contour and further arranged to function as an air baffling means in said intake tube, said needle valve being arcuately curved relative to said contour of said control body and thereby arranged to control said metering opening on movement of said control body.

5. An apparatus as defined by claim 2, characterized in that said needle valve comprises an elongated curved body portion that is formed as a taper from end to end, said taper being circular at a fixed end and reduced in cross-section toward its other end.

6. An apparatus as defined by claim 5, characterized in that said needle valve further includes upper and lower sides, said upper side being guided by said means defining said metering opening.

7. An apparatus as defined by claim 3, characterized in that said shield means comprises a disc-like member.

8. An apparatus as defined by claim 7, characterized in that said shield means is supported in a receiver body secured to said control body and is returned therein by a securing means.

9. An apparatus as defined by claim 8, characterized in that said fuel metering valve further includes a sheath which encloses said needle valve, said sheath arranged to communicate with a fuel supply means.

10. An apparatus as defined by claim 9, characterized in that said fuel ejection means defines at least one nozzle opening through which the metered fuel is ejected.

11. An apparatus as defined by claim 10, characterized in that said control body front and rear end portions function as a baffle means to control air flow through said intake tube, further wherein said front end portion contacts said intake tube wall during a low rate of air flow and said control body lifts said front end portion away from said intake tube wall on an increasing air flow.

12. An apparatus as defined by claim 11, characterized in that said baffle means moves into a position at full load in which its rear end portion which extends in opposition to air flow is located approximately medially of said intake tube.

13. An apparatus as defined by claim 10, characterized in that said intake tube wall further includes a recessed area and a channel, said rear end portion of said control body arranged to be tilted so that it is received in said recessed area and said at least one nozzle opening feeds fuel through said channel to a zone in front of a throttle valve.

14. An apparatus as defined by claim 3, characterized in that said control body further includes a pivot axis associated with a double lever means, said double lever means influenced by spring means to restore said control body to a predetermined position.

15. An apparatus as defined by claim 13, characterized in that said control body and said throttle valve have a common actuator means.

16. An apparatus as defined by claim 15, characterized in that said intake tube has multiple outlets each provided with a control body, a throttle valve and a common actuator means for each said control body and said throttle valve.

17. An apparatus as defined by claim 15, characterized in that said metering valve is connected to a rotatable bearing lever and said bearing lever is connected through compensating means to an accelerator means.

18. An apparatus as defined by claim 17, characterized in that multiple metering valves are connected to plural rotation bearing levers and said bearing levers are connected through compensation means to an accelerator means.

19. An apparatus as defined by claim 1, wherein said internal combustion engines are mixture-compressing engines with externally supplied ignition.

* * * * *